United States Patent [19]

Melfi

[11] 4,052,031

[45] Oct. 4, 1977

[54] ADJUSTABLE CONCRETE FORM APPARATUS

[76] Inventor: Samuel T. Melfi, 1601 NW. First Court, Boca Raton, Fla. 33432

[21] Appl. No.: 708,566

[22] Filed: July 26, 1976

Related U.S. Application Data

[63] Continuation-in-part of Ser. No. 600,048, July 29, 1975, abandoned.

[51] Int. Cl.[2] ..... E04G 11/06

[52] U.S. Cl. ..... 249/19; 249/34; 249/43

[58] Field of Search ..... 249/19–22, 249/33–47, 205, 207, 210

[56] References Cited

U.S. PATENT DOCUMENTS

| | | | |
|---|---|---|---|
| 1,208,283 | 12/1916 | Britton | 249/21 |
| 1,322,784 | 11/1919 | Greuloch | 249/22 |
| 1,538,815 | 5/1925 | Hunter | 249/38 |
| 1,563,581 | 12/1925 | May | 249/34 |
| 2,400,852 | 5/1946 | Stevenson | 249/21 |
| 3,148,434 | 9/1964 | Gage et al. | 249/185 |
| 3,837,613 | 9/1974 | Sontag | 249/205 |

FOREIGN PATENT DOCUMENTS

| | | | |
|---|---|---|---|
| 80,389 | 10/1961 | France | 249/34 |
| 1,369,466 | 7/1963 | France | 249/36 |

*Primary Examiner*—Francis S. Husar
*Assistant Examiner*—John McQuade
*Attorney, Agent, or Firm*—Oltman and Flynn

[57] ABSTRACT

The concrete form apparatus includes a pair of spaced form sections. The form sections are held in properly spaced relation by spreader sleeves and threaded adjustment means in the form of a threaded rod which engages nuts suitably positioned on the form sections. The form sections can be erected and dismantled from the inside of a building, thus eliminating the need for any type of exterior scaffolding and the expense of erecting and dismantling it. The threaded adjustment means makes it possible to adjust the form sections to the proper horizontal spacing from inside the building. A second threaded adjustment means provides for vertical adjustment of the form sections.

6 Claims, 14 Drawing Figures

FIG. 1
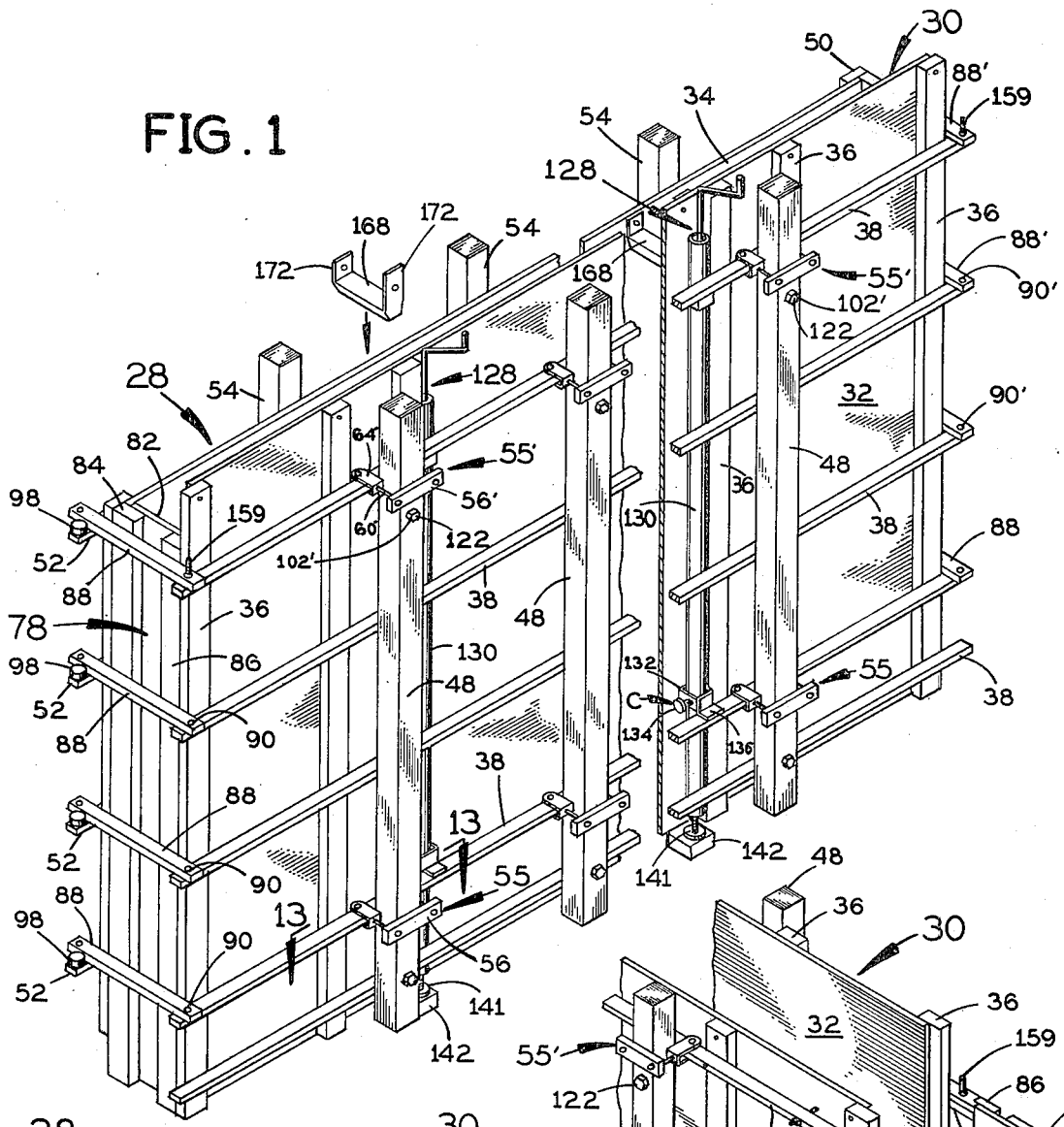
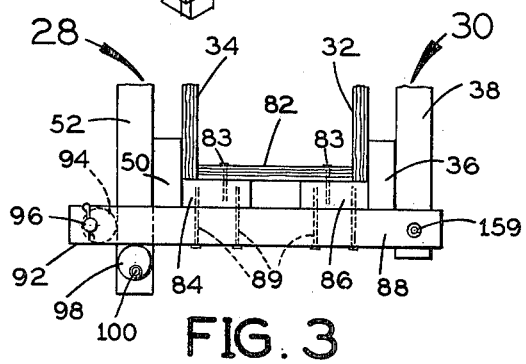
FIG. 3
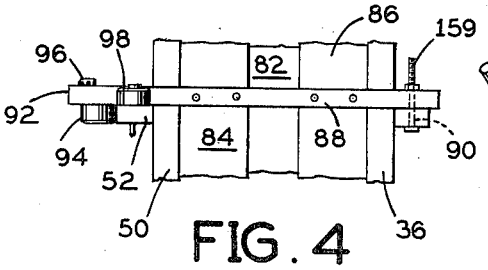
FIG. 4
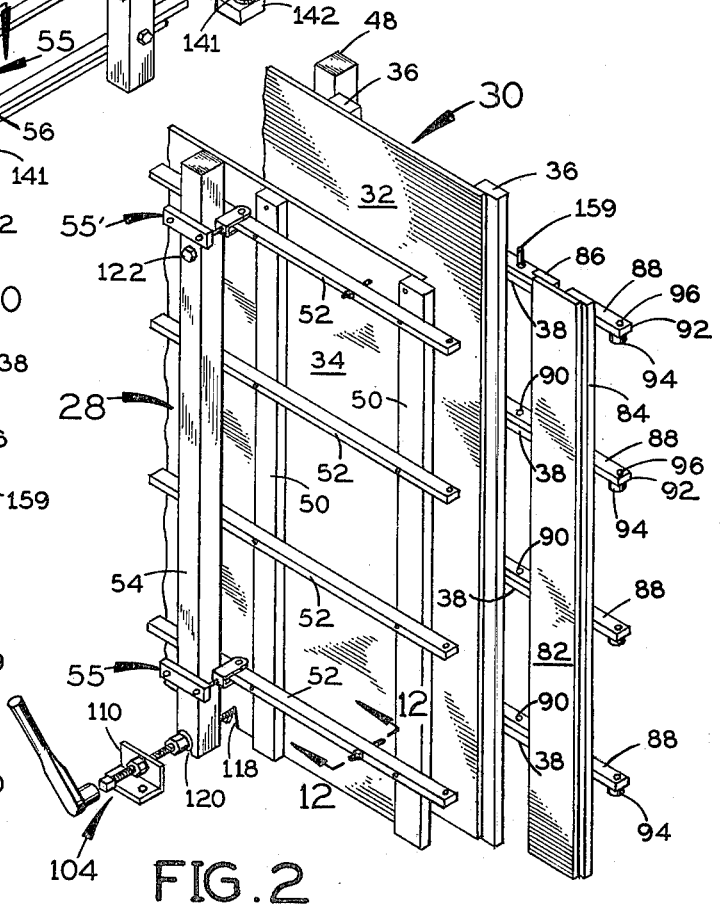
FIG. 2

FIG. 5
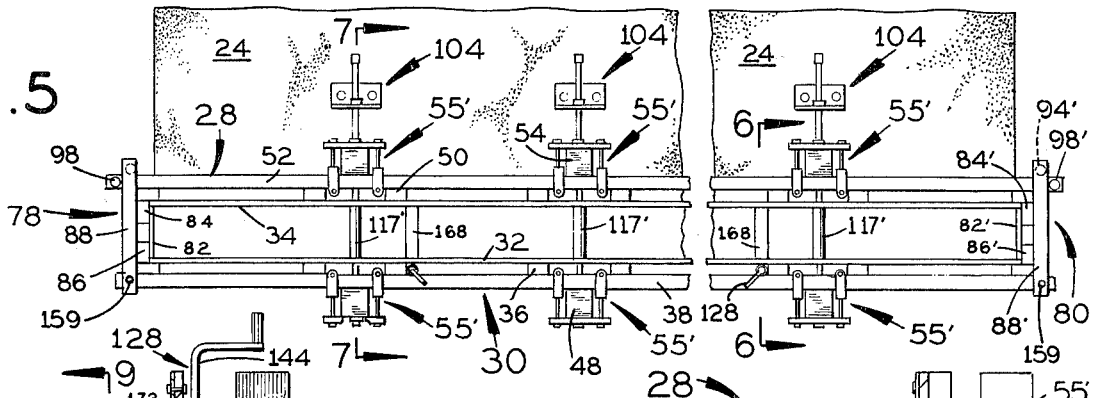
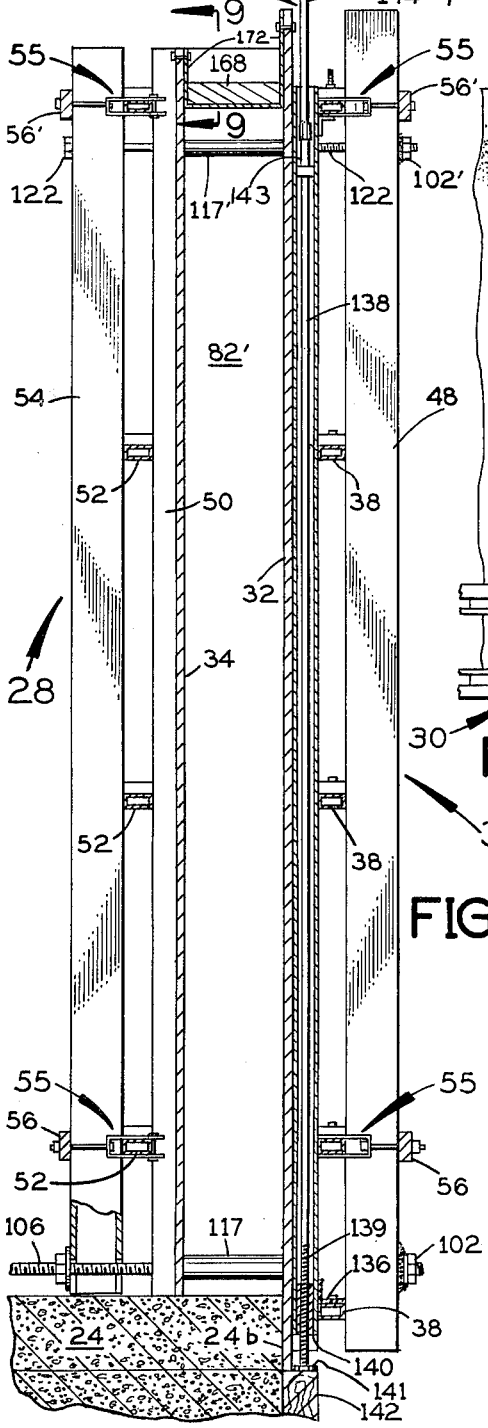
FIG. 8
FIG. 6
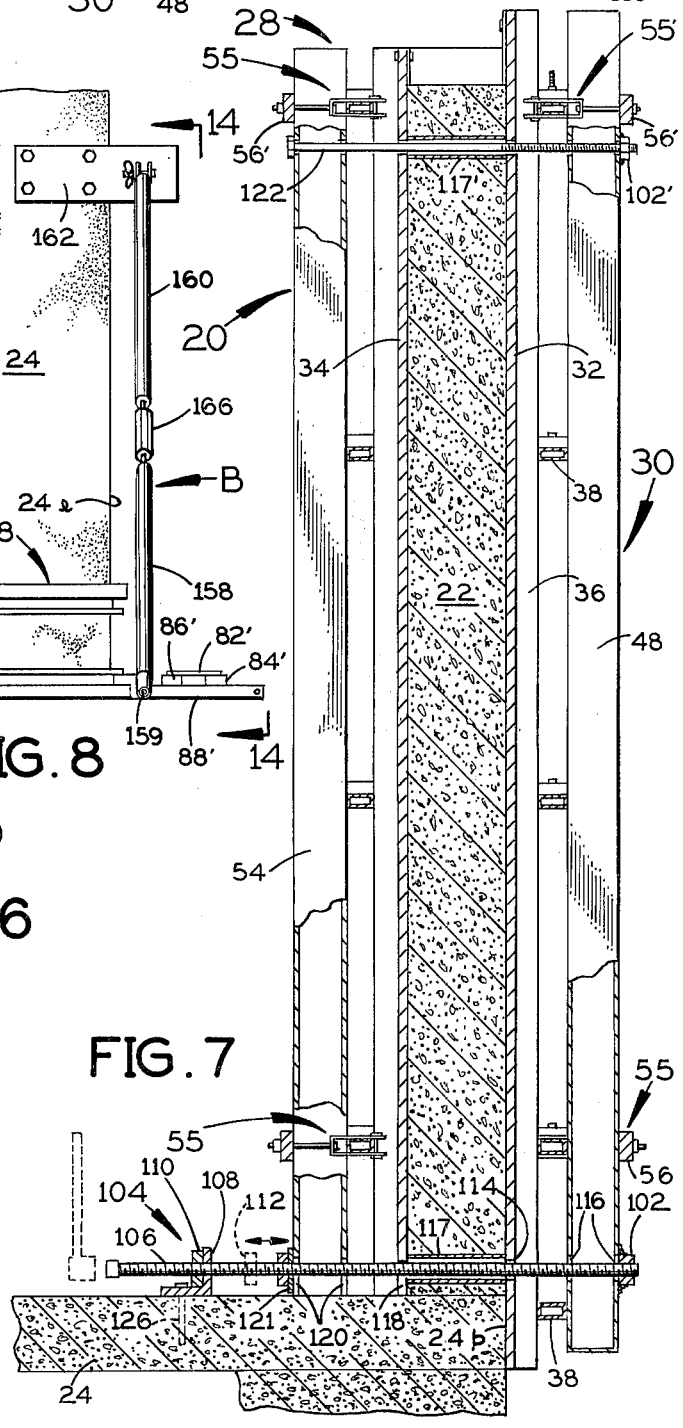
FIG. 7

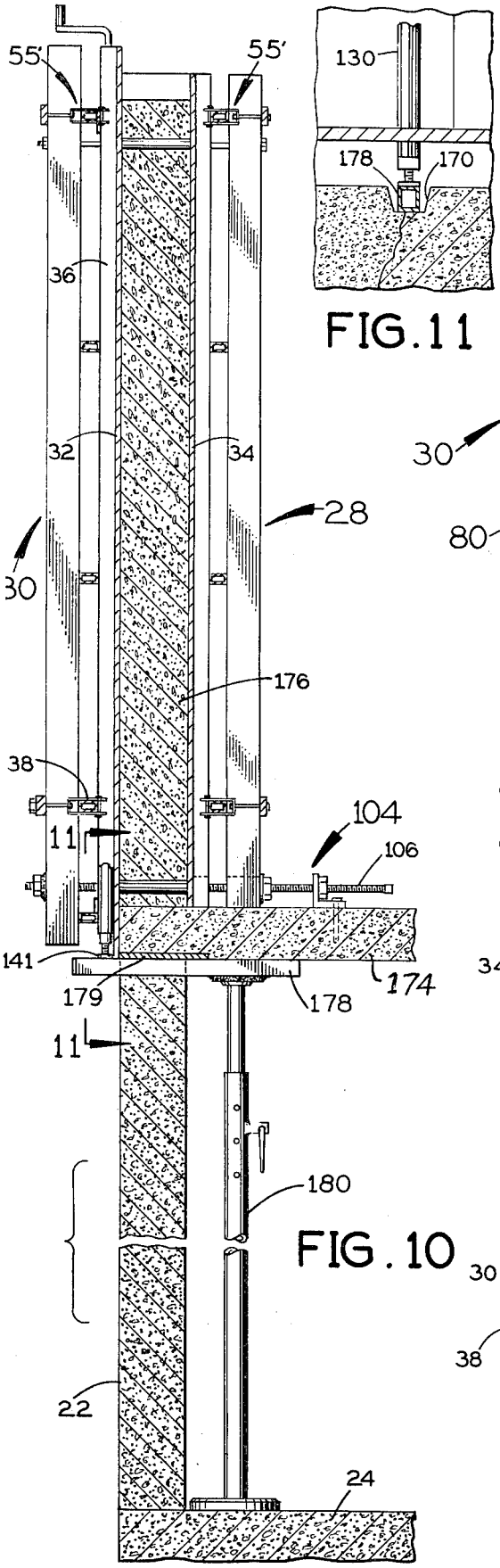
FIG. 10
FIG. 11
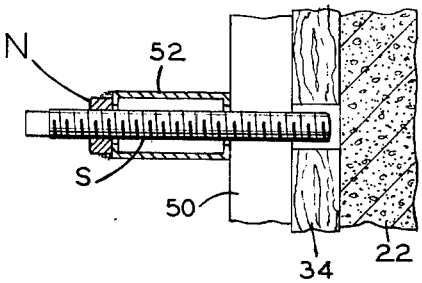
FIG. 12
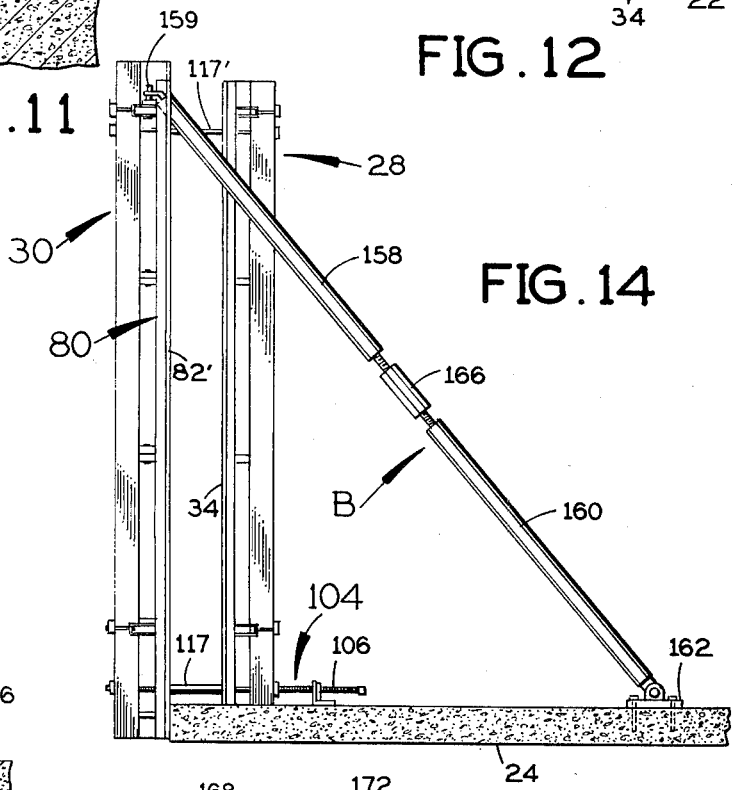
FIG. 14
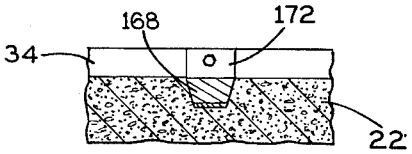
FIG. 9
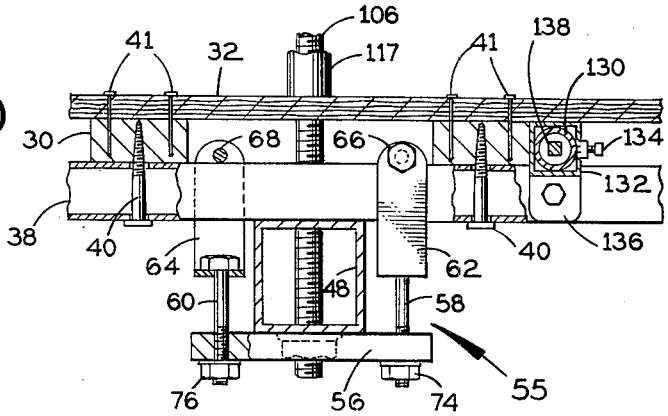
FIG. 13

ADJUSTABLE CONCRETE FORM APPARATUS

RELATED APPLICATION

This application is a continuation-in-part of copending application Ser. No. 600,048 filed on July 29, 1975, now abandoned.

BACKGROUND OF THE INVENTION

Forms for use in casting concrete walls for buildings are normally erected and dismantled by workers standing on scaffolding outside the building. The scaffolding presents a hazard, and it is expensive to erect and dismantle the scaffolding itself.

SUMMARY OF THE INVENTION

The present invention relates to means for producing forms for concrete work and particularly wall construction and has for one of its objects the provision of form elements which can be connected together from inside a building in a manner to simplify erection and disassembly and provide for a free wall. The invention contemplates an arrangement which will reduce form erection and dismantling time and possess other advantages readily apparent to those skilled in this art.

In the preferred embodiment of the invention, the structure includes suitably spaced apart vertical uprights preferably composed of square-sectioned steel tubing which are provided along their lengths at spaced intervals with horizontally arranged reinforcing bars which can also be square in section. Vertical posts are attached to the bars and attached to the posts and secured to the inner surfaces of the vertical bars are facings or lining sheets for the form and between which the concrete is poured.

Two of the above described assemblies form the side walls of the form and are maintained in the required spaced-apart position to accommodate the poured concrete between them to result in a concrete wall of the required thickness.

The above form arrangement rests upon the concrete flooring or other slab on which the wall is to be molded. The two sections of the mold are adjustably connected together by threadable means to secure the proper spacing between them and to hold them in the required setting during the pouring of the concrete. A vertical adjustment means is also provided.

Accordingly, it is an object of the present invention to provide concrete form apparatus for constructing a wall of a building which form apparatus can be erected, adjusted and dismantled from the inside of the building.

Another object of the invention is to enable both a wall and an adjacent section of the floor to be cast with form apparatus operated wholly from inside the building.

A further object of the invention is to support a form apparatus on a cantilevered beam extending from the inside to the outside of a building.

Another object of the invention is to include in the form apparatus a form section for molding an opening in a wall to receive a beam for supporting forms for casting the next highest wall of a building.

Another object of the invention is to provide form sections for casting a wall of a building with a first adjustment means for retaining and spacing the form sections and which can be operated from inside the building, and a second adjustment means for vertically adjusting the form sections from inside the building.

Other objects of this invention will appear from the following description and appended claims, reference being had to the accompanying drawings forming a part of this specification wherein like reference characters designate corresponding parts in the several views.

BRIEF DESCRIPTION OF THE DRAWINGS

FIG. 1 is a perspective view of concrete form apparatus in accordance with a preferred embodiment of the invention;

FIG. 2 is a fragmentary perspective view of one end of the apparatus;

FIG. 3 is a fragmentary plan view showing the end structure of FIG. 2 in a closed condition;

FIG. 4 is a fragmentary elevational view of the structure of FIG. 3;

FIG. 5 is a top plan view of FIG. 1;

FIG. 6 is a sectional view taken along line 6—6 of FIG. 5;

FIG. 7 is a sectional view taken along line 7—7 of FIG. 5;

FIG. 8 is a top plan view of one end of the apparatus after a brace has been connected to it;

FIG. 9 is a fragmentary sectional view taken along line 9—9 of FIG. 6;

FIG. 10 is a sectional view similar to FIG. 6 showing the present concrete form apparatus at an upper floor of a multi-story building;

FIG. 11 is a fragmentary sectional view taken along line 11—11 of FIG. 10;

FIG. 12 is a fragmentary sectional view taken along line 12—12 of FIG. 2;

FIG. 13 is a fragmentary sectional view taken along line 13—13 of FIG. 1; and FIG. 14 is an elevational view of one end of the apparatus of FIG. 1 with a brace connected to it.

Before explaining the disclosed embodiment of the present invention in detail, it is to be understood that the invention is not limited in its application to the details of the particular arrangement shown, since the invention is capable of other embodiments. Also, the terminology used herein is for the purposes of description and not of limitation.

DETAILED DESCRIPTION

The form apparatus 20 (FIG. 7) is used for constructing a concrete wall 22 on a concrete base 24 such as a floor.

The form apparatus 20 includes two horizontally spaced apart, vertical, wall form sections 28 and 30 (FIGS. 1 and 7) connected together for casting a concrete wall on the base 24. The wall form section 30 includes a facing 32 which may be plywood or the like for forming one of the faces of the concrete wall. Wall form section 28 includes a similar facing 34 for forming the opposite face of the concrete wall.

Attached to facing 32 are horizontally spaced, vertical stringers 36 which serve to brace the facing 32. The stringers 36 may be wood or steel bars. Vertically spaced, horizontal bars 38 are clamped against the vertical stringers 36 to further reinforce the form section 30. The bars 38 are preferably hollow steel members.

As best seen in FIG. 13, the horizontal bars 38 are attached to the vertical stringers 36 at the outside of the form section by lag bolts 40. Nails 41 or staples attach the facing 32 to the inside of the stringers 36.

Outside the bars 38, there are vertical walers 48 (FIG. 1) which provide further reinforcement and which cooperate in holding the form sections 28 and 30 on the concrete base 24.

The form section 28 (FIG. 2) includes horizontally spaced, vertical stringers 50, vertically spaced, horizontal reinforcing bars 52, and horizontally spaced, vertical walers 54 arranged in the same manner as the corresponding elements 36, 38 and 48 described previously.

The walers 48 and 54 are closed at the top to prevent wet concrete from getting in.

The horizontal reinforcing bars 52 and the facing 34 are attached to the vertical stringers 50 in the same manner as the corresponding elements in FIG. 13.

The walers 54 and also the walers 48 are clamped respectively against the reinforcing bars 38 and 52 by upper and lower clamp assemblies 55 and 55' (FIG. 1). Referring to FIG. 13, the lower clamp 55 comprises a rigid bar 56 engaging the outside of the waler 48. Two bolts 58 and 60 extend through the bar 56. The bolts 58 and 60 carry clevises 62 and 64 which are bolted around the bar 48 by means of bolts 66 and 68. The threaded ends of the bolts 58 and 60 receive nuts 74 and 76 which are tightened to firmly clamp the waler 54 against the reinforcing bar 38. The upper clamp 55' is of the same construction, and corresponding elements of it have the same reference numerals with a "prime" suffix added in FIG. 1.

The form apparatus 20 further includes two end form sections 78 and 80 (FIG. 5) which are used to form the ends of the concrete wall 22. The nature of the end form sections 78 may be seen most clearly by considering FIGS. 1, 3, and 4 together. The end form section 78 includes a facing 82 extending between facings 32 and 34 when the end form section is closed as in FIG. 3. Attached to the outside of the facing 82 by nails 83 or staples are vertical stringers 84 and 86. Horizontal reinforcing bars 88 are attached to the outside of these stringers by lag bolts 89. The bars 88 are pivoted or hinged to the bars 38 by means of pins 90. The free ends 92 of bars 88 have eccentric cams 94 rotatably attached thereto with pins 96. The free ends of bars 52 on the inner form section 28 have eccentric cams 98 attached rotatably thereto with pins 100. Both sets of cams 94 and 98 and their pins are manually removable from the respective bars 88 and 52. The eccentric cams 94 are removably mounted on the underside of bars 88 and the eccentric cams 98 are removably mounted on the upper side of bars 52. The bars 88 overlap the bars 52 when the end section 78 is closed, and at this time the cams 98 on bars 52 engage the outside of bars 88 and the cams 94 on bars 88 engage the outside of bars 52. The end section 78 may be swung to the open position after removing the cams 94 and 98 and their respective pins 96 and 100 from the bars on which they are mounted.

At the opposite end of the apparatus, the end form section 80 is similarly pivoted to the outer form section 30 and similar removable cams are provided for locking this end form section closed against the inner form section 28. Corresponding elements at this end form section 80 are given the same reference numerals, with a "prime" suffix added, as those of the end section 78.

From FIG. 5 it will be apparent that when the two end form sections 78 and 80 are closed their respective facings 82 and 82' close the space between the facings 32 and 34 on the outer and inner form sections 30 and 28, respectively, at each end of the apparatus. At this time, the stringers 84 and 86 on the end form section 78 abut against the adjacent end edges of the facings 32 and 34 on the outer and inner form sections, respectively, and the stringers 84' and 86' on the other end form section abut against the adjacent edges of facings 32 and 34, respectively. Nuts 102 and 102' are welded to the outside of each of the vertical walers 48 on the outer form section 30, as shown in FIGS. 1 and 7, near the respective lower and upper clamp assemblies 55 and 55'

When the form apparatus 20 is being erected, the outer form section 30 is hoisted into approximate position relative to the concrete base as shown in FIG. 1 by means of a crane. The end sections 78 and 80 are in their open positions on the outer form 30, extending substantially co-planar with the latter.

A series of first adjusting means 104 (FIG. 7) is provided for holding the outer form section 30 in place and also for adjusting the spacing between the inner and outer form sections 28 and 30, respectively.

Each adjusting means 104 includes a long, threaded rod 106. Initially, the rod 106 carries loosely an angle support 108, and the rod passes freely through this angle support 108. A threaded nut element 110 threadedly engages the rod on the left side of the support 108 as shown in FIG. 7. Another threaded nut element 112 threadedly engages the rod 106 on the opposite side of the support 108, and this nut element 112 may initially be in the position shown in dashed lines in FIG. 7.

The threaded rod 106 is passed through an opening 114 in the facing 32 on the outer form section 30 and similar openings 116 in the corresponding waler 48. The rod 106 is screwed into the lower nut 102 on the outer side of the waler 48. The rod 106 carries a spacer sleeve 117 which is placed on the left side of facing 32, as shown in FIG. 7.

After the nut 112 has been threadedd onto the rod 106, the angle support 108 is threaded onto rod 106 and is anchored to the base 24 by means of a bolt 126, which may be shot into the base. Then the nut 110 is threaded onto rod 106.

Following this, a turnbuckle brace B (FIGS. 8 and 14) at each end of the outer form section 30 is connected between the concrete base 24 and the outer form section. As shown in FIG. 8, this turnbuckle brace is located beyond the adjacent end edge **24*e* of the concrete base 24 so as not to interfere with the later positioning of the inner form section 28**.

Each brace B comprises a lower arm 160 whose lower end is pivotally connected to a mounting plate 162 which is anchored to the concrete base, and an upper arm 158 whose upper end is pivotally connected to a stud 159, projecting up from the corresponding uppermost reinforcing bar 88 or 88' on the adjacent end section 78 or 80 of the apparatus. This stud 159 is aligned vertically with the pivot pin 90 or 90' acting between this end section reinforcing bar 88 or 88' and the corresponding reinforcing bar 38 on the outer form section 30. The upper and lower arms 158 and 160 of each turnbuckle brace B have their adjacent ends oppositely screw-threaded and threadedly received in opposite ends of a turnbuckle 166, which may be turned in one direction to lengthen the brace or in the opposite direction to shorten it. The turnbuckle braces are adjusted to position the outer form 30 vertical with the lower end of its face 32 flush against the adjacent side edge **24*b*** of the concrete base.

As shown in FIG. 2, the lowermost and uppermost reinforcing bars 52 on the inner form section 28 are now located above the top surface of the concrete base 24. Nuts N (FIG. 12) are welded at suitable intervals to the outside of each of these reinforcing bars. At each nut N a set screw S passes through aligned openings in the reinforcing bar 52 and the facing 34 of the inner form section. This set screw is threadedly received by nut N and its inner end if flush with the inside face of the facing 34, so as to engage the adjacent face 22 of the concrete wall. These set screws S are used later to strip the inner form section from the wall, as explained hereinafter.

The crane now may be released from the outer form section 30 because the latter is being held by the turnbuckle braces 158 at its upper end and the rods 106 at its lower end.

Next the crane lowers the inner form section 28 between the turnbuckle braces B at the opposite ends of the assembly until its bottom edge rests on the concrete base 24, as shown in FIG. 14. The inner form section 30 has aligned recesses or slots 118 and 120 at the bottom of its facing 34 and each waler 54, as shown in FIG. 7. These slots fit loosely over the respective rods 106, so that these rods do not prevent the inner form section from being lowered into engagement with the concrete base 24. The slot 120 on the left side of the waler 54 in FIG. 7 is covered by a metal washer 121, which will be engaged by the nut 112 when the assembly is completed.

In the vicinity of the upper clamps 55', tie rods 122 are inserted through aligned openings in the walers 54 and the facing 34 of the inner form section 28 and through correspondingly positioned openings in the facing 32 and the walers 48 on the outer form section 30. These tie rods are threadedly received in the aforementioned nuts 102' on the outside of the walers 48 on the outer form section 30, and at the opposite end their heads engage the corresponding walers 54 on the inner form section 28 to hold the upper ends of the outer and inner form sections parallel. As shown in FIG. 7, a spacer sleeve 117' encircles each tie rod 122 between the respective facings 32 and 34 on the outer and inner form sections to maintain them spaced apart at their upper ends the same distance as they are spaced apart at their lower ends by the spacer sleeves 117.

The vertical position of the outer and inner form sections 30 and 18 may be adjusted by means of two or more vertical adjustment means designated generally by the reference numeral 128 in FIGS. 1 and 6.

At each such adjustment means a vertical sleeve 130 extends down between the facing 32 and the horizontal reinforcing bars 38 on the outer form section 28. At two or more of the reinforcing bars 38, each vertical sleeve 130 is attached to the reinforcing bar by a clamp arrangement C, only one of which is shown in FIG. 1 for the sake of simplicity. This clamp comprises a collar 132 encircling the sleeve 130 and fastened to it by a set screw 134. The collar 132 is joined to an angle member 136 which is bolted or otherwise fastened to the adjacent horizontal reinforcing bar 38 in the outer form section.

As elongated, rigid rod 138 extends down through the sleeve 130 and is screw-threaded near its lower end, as shown at 139 in FIG. 6, where it threadedly engages a nut 140 on the lower end of sleeve 130. Below this nut the rod presents a transverse foot 141 which engages the top of a two-by-four or other rigid piece 142, which is temporarily fastened to the edge of the concrete base 24 below the floor surface. A square rod 143 is welded to the upper end of rod 138, and a crank 144 is engageable with this square rod for turning the rod 138 to raise or lower the outer and inner form sections, by virtue of the screw-threaded engagement between the rod 138 and the nut 140 on sleeve 130 and the engagement of the foot 141 on the lower end of rod 138 with the two-by-four 142.

Now, with the outer and inner form sections 30 and 28 extending parallel to each other, and with the lower end of the outer from section 30 engaging the adjacent edge **24*b* of the concrete base 24 and the inner form section 28 resting on the concrete base inward from this edge, the nuts 110 are held against the angle supports 108 on the base and the threaded rods 106 are turned to pull the lower end of the outer form section 30 tight against the adjacent edge 24*b* of the concrete base. Each nut 112 is tightened against the corresponding washer 121 to hold the inner form section 28 tight against the adjacent end of the lower space-sleeve 117**.

It will be evident that the adjustment means 128 (FIGS. 1 and 6) enables the vertical position of the form apparatus to be adjusted from inside the building and the adjustment means 104 (FIG. 7) enables its horizontal position to be adjusted from inside the building. Also, the erection of the form sections 30 and 28 is accomplished entirely from the inside of the building so that there is no need for scaffolding on the outside of the building. This is safer and it saves the time and expense involved in erecting and dismantling the scaffolding.

With the outer and inner form section 30 and 28 clamped in place to the concrete base 24, additional turnbuckle braces (not shown) are connected to the inner form section 28 before disconnecting the turnbuckle braces from the outer form section 30. The end form sections 78 and 80 are closed and locked to the inner form section 28, as shown in FIG. 1.

With the form now properly erected and closed, wet concrete is poured down into the rectangular space bounded by the facings 32, 34, 82 and 82' of the form sections to a form a concrete wall extending up from the base 24.

Before the concrete is poured, an insert 168 shown in FIG. 9 may be placed at the top of the form sections 28 and 30 so as to mold an opening 170 in the top of the wall 22 for receiving a beam for use when constructing the wall at the next story of the building. The insert 168 may be a tapered wooden block or metal tubing, and it molds the opening 170 in the top of wall 22 having the cross-section shown in FIG. 11. The insert 168 may be held on a carrier 172 which straddles the inner and outer form sections 28 and 30.

In the manner shown in FIGS. 10 and 11, the opening 170 is used when the inner and outer form sections 28 and 30 are hoisted to the next higher floor level 174 for constructing a wall 176 for the next story of the building. A vertically adjustable shore post 180 extends up from the lower floor 24, and a horizontal beam 178 is welded to the upper end of this shore post. This beam is forced by the shore post up against the bottom of the next higher floor 174. It extends through the opening or recess 170 in the top of the lower wall 22, and it extends laterally beyond this wall to provide a bottom support for the vertical adjustment means 128 in the use of the form apparatus at the next story for the building. A sheet metal cover plate 179 is placed over the recess 170 and beam 178 to prevent concrete from entering this recess when the floor 174 above is poured.

At each floor of the building, after the concrete wall has set the present form apparatus may be stripped from it in the following sequence:

1. Open the end form sections 78 and 80 after removing the respective sets of locking cams 94, 98 and 94', 98' by which they were locked to the inner form section 28.
2. Connect the turnbuckle braces B again to the outer form section 30.
3. Turn the set screws S (FIG. 12) to strip the inner form section 28 away from the wall 22.
4. Remove the inner form section 28 after disconnecting the upper tie rods 122 from the upper nuts 102' on the outer form section 30 and loosening the nuts 112 bearing against the lower end of the inner form section at the rods 106.
5. Re-insert the upper tie rods 122 through the spacer sleeves 117' in the wall 22 and the nuts 102' on the outer form section 30, tightening these tie rods against the inside face of the wall 22 to provide an edge form for the floor which is to be poured at the next floor level.
6. After pouring the floor 174 above, attach the crane to the upper end of the outer form section 30 and disconnect the turnbuckle braces B from the outer form section.
7. Next, strip the outer form section 30 from the wall 22 by releasing nut 110 from angle support 108 enough to provide room to break the bond between form section 30 and wall 22, and turn the nut 112 along rod 106 until it engages the angle support 109, and continue to turn nut 112 to push the outer form 30 away from wall 22.
8. Release the threaded rods 106 and 122 from the outer form section 30.

I claim:

1. A form apparatus for constructing a concrete building wall to extend up from the floor of the building at an outside edge of said floor without using scaffolding at the outside of the building, said form apparatus comprising:

an outer vertical form section having a lower end with an inside face for abutting engagement with said outside edge of the floor;

a pair of vertical end form sections at the opposite ends of said outer form section;

vertical pivot means at each end of said outer form section acting between the latter and the adjacent end form section for pivotal adjustment of each end form section to a position extending inward from said outer form section;

means on said outer form section near the top at each end for operatively connecting the upper end of a respective floor-mounted turnbuckle brace to said outer form section to support the latter from said floor;

elongated screw-threaded rods extending generally horizontally closely above said floor and operatively connected to said outer form section near its lower end, brackets loosely receiving said rods and attachable to said floor, and nuts threadedly engaging said rods at the inner side of said brackets for pulling and holding the lower end of the outer form section tight against the outside edge of the floor;

lower spacer sleeves loosely receiving said rods and extending inward from said outer form section;

a vertical inner form section having upwardly extending slots therein which are open at its bottom edge to slip freely over said rods at the inner end of said lower spacer sleeves;

nuts threadedly mounted on said rods outward from said brackets for holding the lower end of said inner form section against the respective inner ends of said lower spacer sleeves;

tie rods connecting said inner form section to said outer form section near their upper ends;

and means operatively associated with said end form sections for releasably locking said end form sections to said inner form section with said end form sections extending inward from said outer form section.

2. A form apparatus according to claim 1, wherein said means for operatively connecting the turnbuckle braces to said outer form section are upwardly projecting posts which are vertically aligned with said vertical pivot means at the opposite ends of the outer form section.

3. A form apparatus according to claim 1, wherein:

said inner form section has a plurality of vertically spaced, horizontal reinforcing bars at its inner side which project beyond its opposite ends;

and each of said end form sections has a plurality of vertically spaced, horizontal reinforcing bars at the outside which project beyond the side edge of the respective end form section away from said outer form section and are positioned for overlapping relationship with said projecting ends of said reinforcing bars on the inner form section;

and wherein said means for releasably locking said end form sections to said inner form section comprises:

cams on said reinforcing bars on the inner form section which are rotatably adjustable into and out of locking engagement with the outside of the respective reinforcing bars on the respective end form sections;

and cams on said reinforcing bars on each end form section which are rotatably adjustable into and out of locking engagement with the respective reinforcing bars on the inner form section at the inner side of the latter.

4. A form apparatus according to claim 1, and further comprising a vertical adjustment arrangement having:

a plurality of vertical sleeves spaced apart along said outer form section and rigidly connected to the latter;

a plurality of elongated vertical rods extending rotatably down through said vertical sleeves;

a respective nut at the lower end of each vertical sleeve threadedly engaging the corresponding rod;

a respective transverse foot on the lower end of each rod below the respective nut for engagement with a horizontal surface below the outer form section;

and a crank operatively associated with each vertical rod insertable down into each sleeve at the top for operative connection to the upper end of the respective rod to turn the latter for vertically adjusting the outer form section from inside the building.

5. A form apparatus according to claim 4, and further comprising:

an insert attached to the inner and outer form sections and extending completely across the space between them at their upper ends to mold a recess in the top of the wall across its complete thickness at its upper end for receiving a shore post-attached beam providing said horizontal surface for engagement by the transverse foot on the lower end of the correspondingly positioned elongated vertical rod in the form apparatus when the form apparatus is at the next higher floor level of the building.

6. A form apparatus according to claim 1, wherein said inner form section has a facing for forming the inner face of the concrete wall, a first set of reinforcing bars attached directly to said facing, and a second set of hollow reinforcing bars extending transverse to the bars of said first set and attached to the latter inwardly from said facing, and further comprising means for stripping said facing of the inner form section from the concrete wall, said stripping means comprising:

nuts affixed to certain of said reinforcing bars of the second set between the reinforcing bars of the first set and inwardly from the latter;

said facing of the inner form section having openings therethrough which are aligned with said nuts affixed to said reinforcing bars;

and set screws threadedly received in said nuts affixed to said reinforcing bars and extending through the corresponding hollow reinforcing bars of the second set and between the reinforcing bars of the first set and through said openings in the facing for abutting engagement with the inner face of the concrete wall.

* * * * *